US011766675B2

(12) United States Patent
Hobbs

(10) Patent No.: US 11,766,675 B2
(45) Date of Patent: Sep. 26, 2023

(54) SPECIAL IMPROVEMENT PACKAGE TO HEAVY DUTY GRINDERS FOR PROCESSING THICK WASTES AND SLICK WIPES IN COMMERCIAL AND RESIDENTIAL APPLICATIONS AND USE CALLED A GORILLA GRINDER

(71) Applicant: Joel Hobbs, Anderson, IN (US)

(72) Inventor: Joel Hobbs, Anderson, IN (US)

( * ) Notice: Subject to any disclaimer, the term of this patent is extended or adjusted under 35 U.S.C. 154(b) by 229 days.

(21) Appl. No.: 17/115,131

(22) Filed: Dec. 8, 2020

(65) Prior Publication Data

US 2021/0170421 A1 Jun. 10, 2021

Related U.S. Application Data

(60) Provisional application No. 62/945,252, filed on Dec. 9, 2019.

(51) Int. Cl.

| | |
|---|---|
| ***B02C 18/24*** | (2006.01) |
| ***B02C 18/00*** | (2006.01) |
| ***B02C 23/36*** | (2006.01) |
| ***B02C 18/22*** | (2006.01) |
| ***B02C 18/18*** | (2006.01) |
| ***F04D 7/04*** | (2006.01) |
| ***F04D 29/22*** | (2006.01) |
| *B02C 18/16* | (2006.01) |

(52) U.S. Cl.

CPC ..... *B02C 18/0092* (2013.01); *B02C 18/18* (2013.01); *B02C 18/2225* (2013.01); *B02C 18/24* (2013.01); *B02C 23/36* (2013.01); *F04D 7/045* (2013.01); *F04D 29/2288* (2013.01); *B02C 2018/162* (2013.01)

(58) Field of Classification Search

CPC ..... B02C 18/0092; B02C 18/0084; B02C 18/2225; B02C 18/24; B02C 18/16; B02C 23/36; F04D 7/045; F04D 29/2288; F04C 2/00

USPC ..... 29/402.03

See application file for complete search history.

(56) References Cited

U.S. PATENT DOCUMENTS 3,325,107 A 6/1967 Peterson
3,439,878 A 4/1969 Reaux
(Continued)

FOREIGN PATENT DOCUMENTS

JP 5019690 9/2012

*Primary Examiner* — Faye Francis

(74) *Attorney, Agent, or Firm* — Ritchison Law Offices, PC; John D Ritchison

(57) ABSTRACT

An improvement kit for heavy duty grinders to process thick wastes in commercial and residential applications made of a two directional cutter having a two-blade cutter edge, a multi aperture die cup, a shaft for pump with an anti-rotational feature, a mimicking component for mimicking three phase drive to a motor stator on the pump, a control board/panel and circuitry and wiring to interconnect the components and a stator winding that allows the kit to provide a grinding solution for contamination including common household trash, a contraband material used in methamphetamine and opioid addictions, a fibrous product including wet wipes with nylon products, and heavy materials that can cause a typical grinding system to be "jetted" which requires continual maintenance and costly repairs.

16 Claims, 9 Drawing Sheets

(56) References Cited

U.S. PATENT DOCUMENTS

Figure 1A:
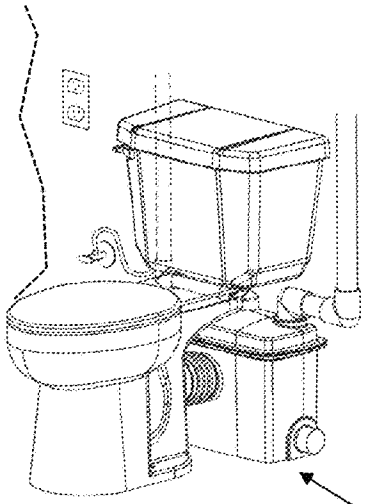
Figure 1B:
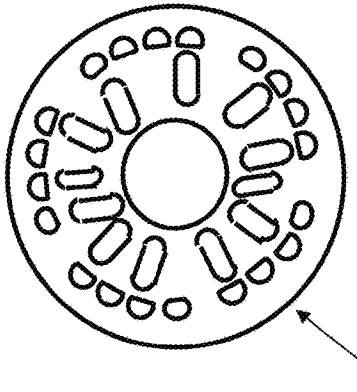
Figure 1C:
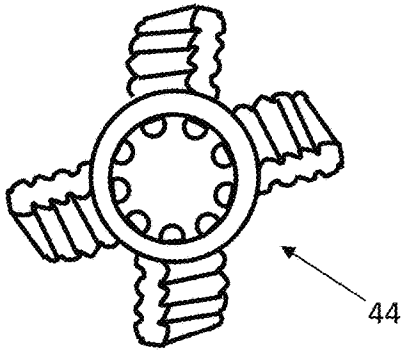
Figure 1D:
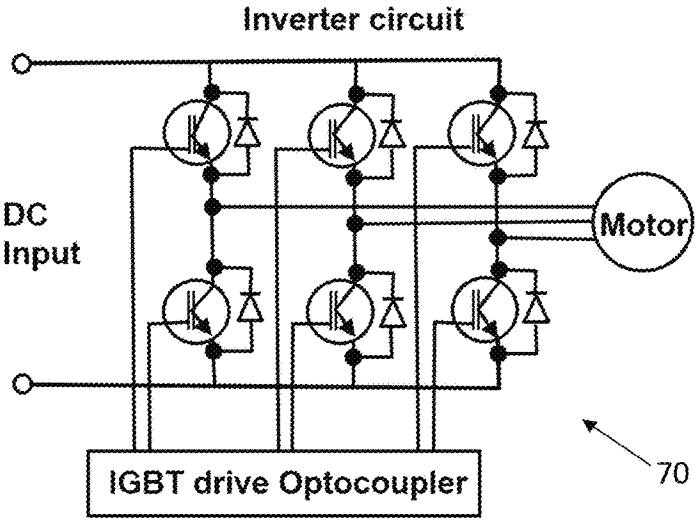
Figure 1E:
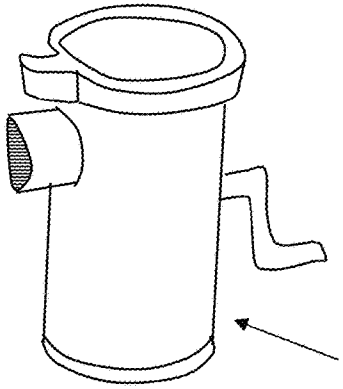
Figure 1F:
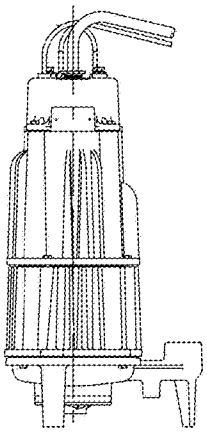
Figure 2A:
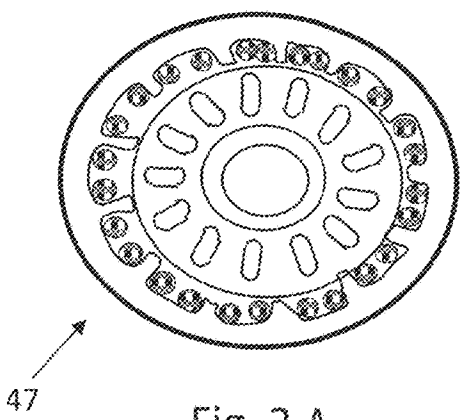
Fig. 2 A Prior Art
Figure 2B:
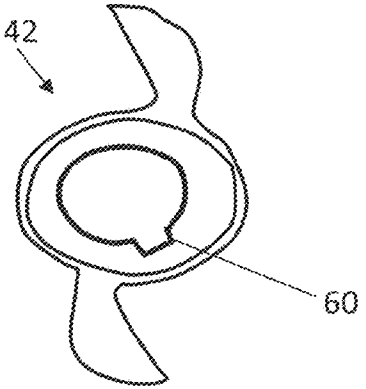
Fig. 2 B Prior Art
Figure 2C:
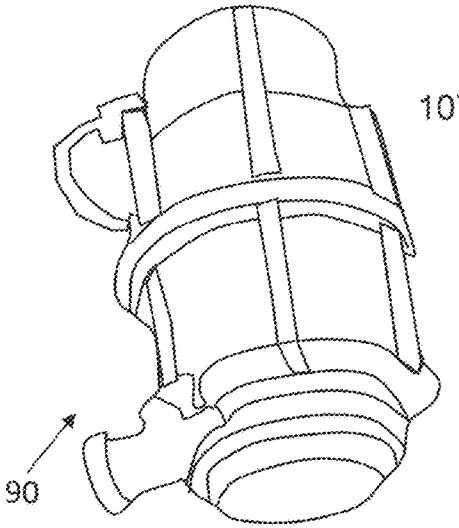
Fig. 2 C Prior Art
Figure 2D:
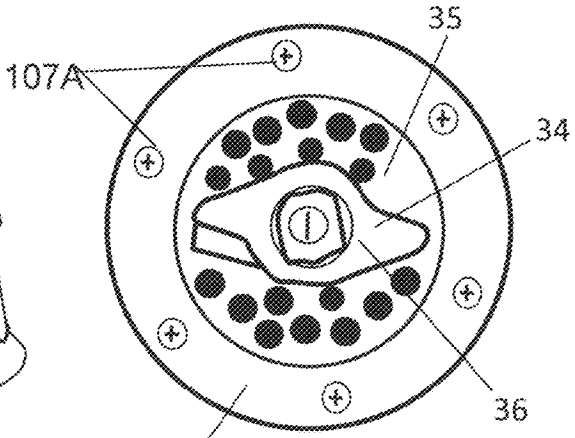
Fig. 2 D Prior Art
Figure 2E:
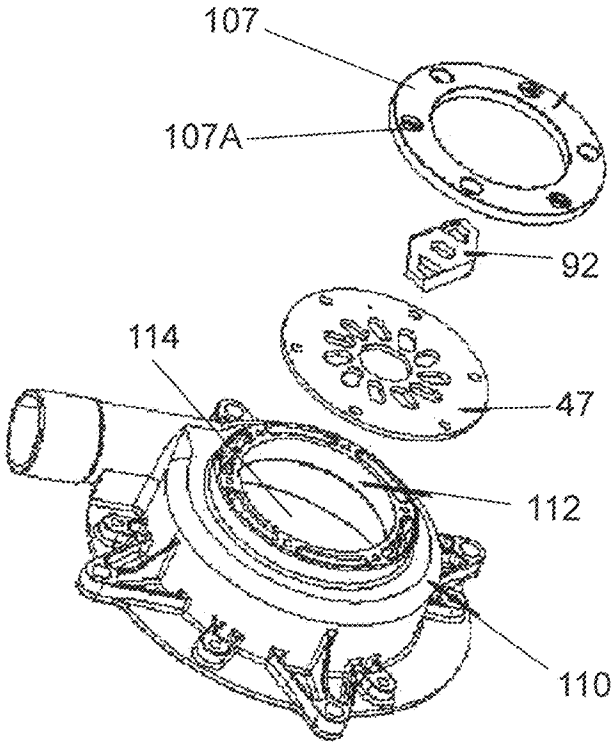
Fig. 2 E Prior Art
Figure 2G:
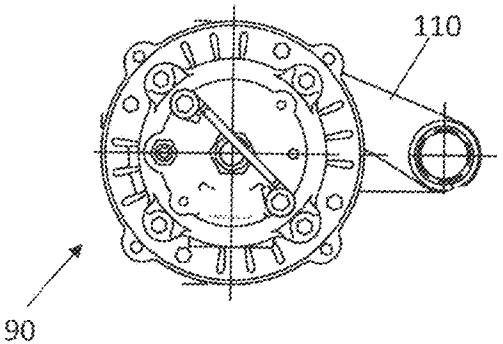
Fig. 2 G Prior Art
Figure 2F:
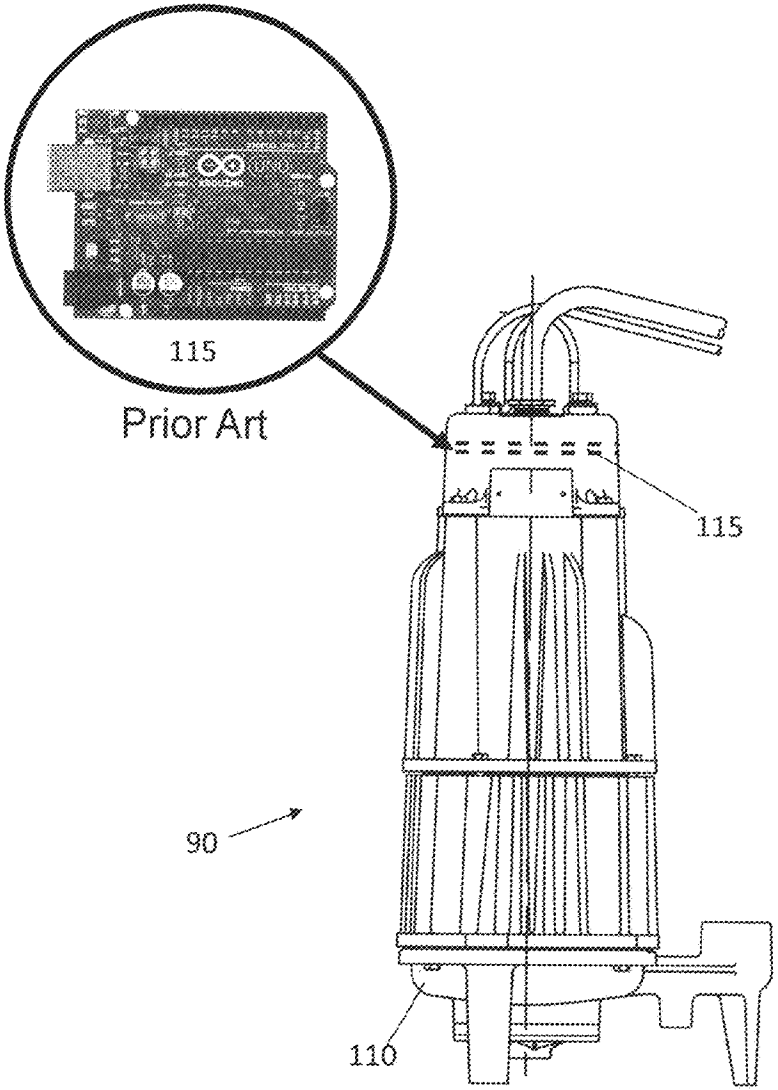
Fig. 2 F Prior Art

| | | | | |
|---|---|---|---|---|
| 6,679,692 | B1 * | 1/2004 | Feuling | F04C 11/001 418/200 |
| 6,808,374 | B2 * | 10/2004 | Phallen | F04C 13/005 418/257 |
| 6,854,673 | B2 | 12/2005 | Strutz et al. | |
| 7,121,490 | B2 | 10/2006 | Gubler et al. | |
| 8,186,975 | B2 | 5/2012 | Kochan | |
| 8,500,050 | B2 | 8/2013 | Ryder | |
| 9,133,853 | B2 * | 9/2015 | Davis | F04D 29/628 |
| 9,475,059 | B2 | 10/2016 | Vallen et al. | |
| 9,695,844 | B1 * | 7/2017 | Bonny | F16H 61/44 |
| 2004/0173697 | A1 | 9/2004 | Berger et al. | |
| 2005/0224611 | A1 | 10/2005 | Gubler et al. | |
| 2007/0131808 | A1 | 6/2007 | Anderson et al. | |
| 2011/0262288 | A1 * | 10/2011 | Leaverton | F04C 2/22 417/572 |
| 2014/0319252 | A1 | 10/2014 | McClory | |
| 2015/0374906 | A1 * | 12/2015 | Forsell | A61B 5/686 604/151 |
| 2017/0008134 | A1 * | 1/2017 | Stuckey | B23P 6/00 |
| 2019/0210036 | A1 * | 7/2019 | Chavez | B02C 23/36 |
| 2020/0182243 | A1 * | 6/2020 | Bendixen | F04C 13/001 |
| 2021/0048023 | A1 * | 2/2021 | Crawford | F04C 11/001 |

* cited by examiner

Prior Art 48
47

Dual Direction
Cutter Plate 47
45
65
44

48
62, 63
45
42

45
63, 65
43
45

Dual Edge
Cutter 45

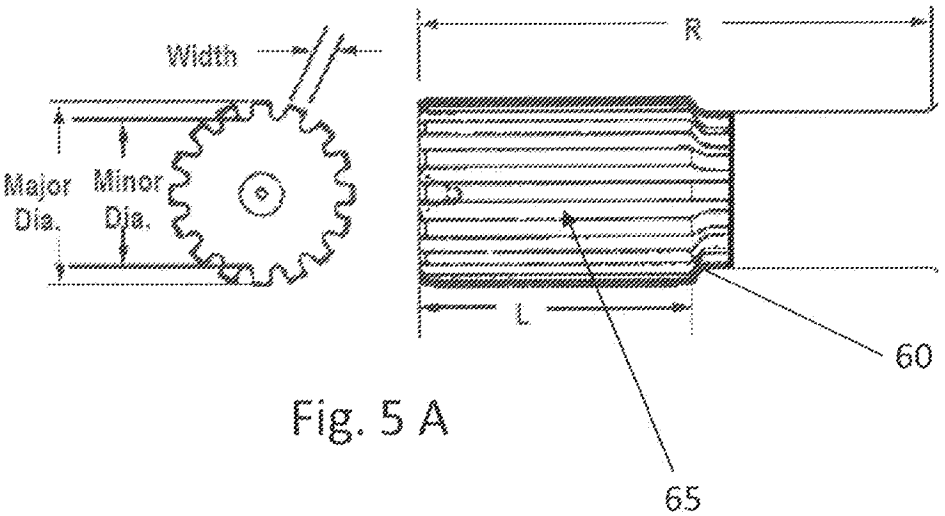
Fig. 5 A
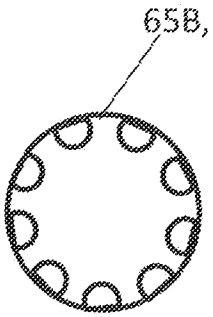
Fig. 5 B
Fig. 5 C
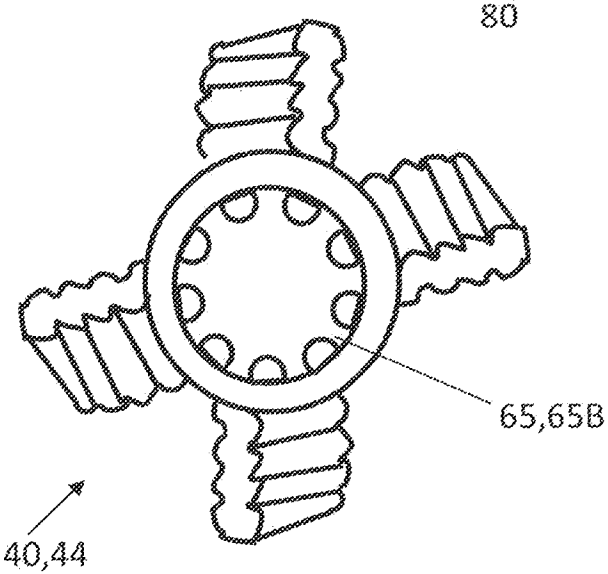
Fig. 5 D
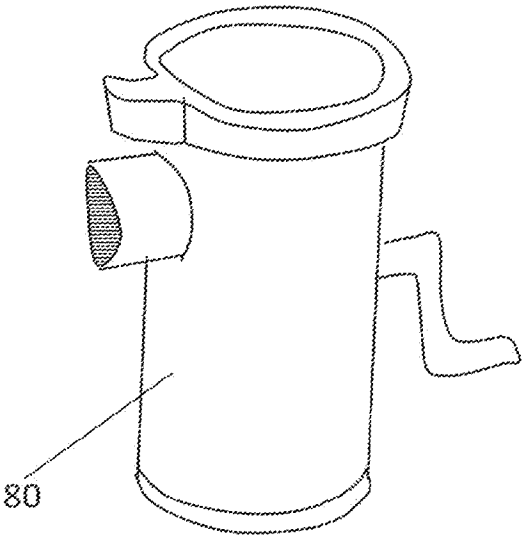
Fig. 5 E

*Install either freestanding or behind a wall!*

SPECIAL IMPROVEMENT PACKAGE TO HEAVY DUTY GRINDERS FOR PROCESSING THICK WASTES AND SLICK WIPES IN COMMERCIAL AND RESIDENTIAL APPLICATIONS AND USE CALLED A GORILLA GRINDER

CROSS-REFERENCE TO RELATED APPLICATIONS

This application claims the benefit of United States Provisional Patent Application with Ser. No. 62/945,252 filed Dec. 9, 2019, by Joel Hobbs. The application was entitled "Special improvement package to heavy duty grinders for processing thick wastes and slick wipes in commercial and residential applications and use called a Gorilla Grinder".

FIELD OF INVENTION

This invention relates to a Special improvement package to heavy duty grinders for processing thick wastes and slick wipes in commercial and residential applications and use called a Gorilla Grinder. Particularly this invention relates generally to grinder pumps and waste disposers and, more particularly, to a pump or waste disposer having a variable speed motor such as a switched reluctance machine. The pump with the improved grinder kit relates to an apparatus that grinds or mills materials and more specifically, the invention relates to an inline apparatus and grinding mechanism that grinds or mills process materials. The grinder pump kit is effective for pumping liquids and slurries containing solid matter, including various types of refuse, and for the improved grinding of the solid matter which thereafter can be processed for disposal. This relates to improvements in pumping apparatus and more particularly, but not by way of limitation, to a disintegrator pump for liquefying solid matter, such as waste products, or the like, for facilitating the draining or discharging thereof.

Jamming is a problem that can occur in grinder pumps and disposers. Jamming occurs when hard objects such as needles, inorganic matter or bones enter the pump and get stuck between the cutters or lugs of the rotating grinding plate. Accordingly, a unit having a variable speed motor or a reversible motor improves the performance. The motor current will increase to produce a maximum torque and the motor speed can decrease to zero instantly and reverse direction. In this anti-jamming mode, a maximum current is reached, which helps relieve the jam.

FEDERALLY SPONSORED RESEARCH

None.

SEQUENCE LISTING OR PROGRAM

None.

BACKGROUND-FIELD OF INVENTION AND PRIOR ART

This section is not Applicable to Provisional Applications. However, as far as known, there are no Special improvement package to heavy duty grinders for processing thick wastes and slick wipes in commercial and residential applications and use called a Gorilla Grinder or the like. It is believed that this product is unique in its design and technologies.

BACKGROUND

Cutting blade assemblies are used in a wide variety of applications to generally reduce the particle size of the medium being processed. Grinder pumps include a motor that rotates an impeller and an associated cutting blade assembly. Fluid and debris suspended within the fluid are drawn into the grinder pump where the cutting blade assembly attempts to reduce the particle size of the suspended debris before the impeller pumps the resulting slurry to a downstream location. In addition, many Flushable Wipes Don't Break Down. Flushable wipes are often deemed to be "flushable" if they pass an industry trial known as the "slosh box test." This test involves rocking wipes back and forth in water to see how quickly they disintegrate. However, according to Cynthia Finley, director of regulatory affairs for the National Association of Clean Water Agencies, in the New York Times, "[The test is] a lot more turbulent-than the flow that you find in a wastewater pipe. "In other words, even after going through the wastewater treatment process, many wipes emerge largely intact and "almost as new."

In one Consumer Reports test, a sheet of toilet paper dissolved in swirling water after about eight seconds, but a flushable wipe was still intact after half an hour. There is no legal requirement for a product to be labeled flushable, and as a result the wipes are clogging up pipes, leading to overflows and sewage backups, and they are getting caught in pumps and other equipment. In the last five years alone, New York City has spent more than $18 million to deal with wipe-related equipment problems. According to the New York Times: "The volume of materials extracted from screening machines at the city's wastewater treatment plants has more than doubled since 2008, an increase attributed largely to the wipes." A City Council bill introduced in February 2015 would prohibit advertising certain wet wipes as flushable, and a public awareness campaign has been started to raise awareness about the proper way to dispose of wipes—in the trash. New York Times Mar. 15, 2015.

Current Typical grinders: Grinder under current condition uses single phase power typical in most residences. There are single phase pumps which utilize a forward reversing action but not in a VFD application which is using a 3/phase drive for rotations, speed, torque requirements to deliver a varying head to gallons per/min. The usual outcome historically with existing pumps/controls is component failure and often pump failures.

Problem Solved

The improvement and problem solved as to grinder pumps and macerating devices should be useful. Problem: In the past several years grinder pits used in removing human fecal matter have encountered a continual problem of contamination. Such contamination would include common household trash, contraband used in Methamphetamine and opioid addictions as well as fibrous products including wet wipes particularly those with nylon products. Since they are not easily broken down the process of disposing has presented itself a problem for the residential consumer to the industrial waste treatment plant resulting in high costly repairs. In addition, in recent months the problems encountered several times are that the typical nature of wet wipes being flushed down the toilet by children that are mentally challenged. Since they are monitored by resident supervisors the problem still exists causing the system to be "jetted" requiring continual maintenance and costly repairs. The proposed solution is to Implement Gorilla technology to redesign the pump used. For example, and not as a limitation, this can be done as an improvement kit in a current basin Zoeller or similar products which are ADA compliant. Please see Web Site:
https://www.zoollerpumps.com/content/literature/fm2800.pdf As an option, the Strainer basket is placed in line with the discharge of the macerating toilet and to be maintained accordingly.

PRIOR ART

A novelty search was conducted to see what improved grinder pump and macerating devices or system were available. It is believed that this product is unique in its design and technologies. A novelty search revealed:

A. Japanese Patent No. JP5019690 was issued in 2003 for a Food waste disposer for crushing mechanism. It is a disintegrating apparatus specially adapted for installation in waste pipes or outlets.

B. U.S. Pat. No. 3,325,107 by Peterson was issued in 1967 for a Disintegrator Pump. It is a mechanism that has a disintegrating system by knives or other cutting or tearing members which chop material into fragments specially adapted for disintegrating garbage, waste, or sewage for wastewater or for garbage.

C. U.S. Pat. No. 3,439,878 by Reaux was issued in 1969 for an Impellor For Food Waste Disposal. It is a pump with a grinding chamber with an impeller for food grinding.

D. U.S. Pat. No. 6,854,673 by Strutz et al. was issued in 2005 for a Food waste disposer having a variable speed motor. This machine provides a food waste disposer having an upper food conveying section, a motor section, a central grinding section and a controller. The upper food conveying section includes a housing forming an inlet to receive food waste. The motor section includes a switched reluctance machine having a rotor and a stator. The rotor imparts rotational movement to a rotatable shaft. The central grinding section is disposed between the food conveying section and the motor section. The food conveying section conveys food waste to the grinding section. The grinding section includes a grinding mechanism where a portion of the grinding mechanism is mounted to the rotatable shaft. The controller is electrically connected to the stator to control the switched reluctance machine. The controller can direct rotational movement to the rotatable shaft and the portion of the grinding mechanism mounted to the rotatable shaft. The controller is further capable of maintaining the rotational movement of the rotatable shaft at more than one rotational speed. The present invention also includes methods of operating a variable speed motor in different operational modes such as idle mode and anti-jamming mode.

E. U.S. Pat. No. 7,121,490 by Gubler et al. was issued in 2006 for a Chopper blade apparatus and method for refining particles. This apparatus is a particle refining mechanism to be integrated into a system including a containment device and an influent conduit. The influent conduit is configured to retain the particle refining apparatus and connected to the containment device. The particle refining apparatus including a shaft, a blade set attached near the end of the shaft and attachment couplings arranged within the influent conduit. A method for refining particles includes introducing particles into an influent conduit, chopping the particles to a desired size with an initial chopping apparatus, directing the chopped particles through the influent conduit, refining the particles to a desired size with a refining apparatus, and moving the particles continuously from the influent conduit through the refining apparatus and into a containment device.

F. U.S. Pat. No. 8,186,975 by Kochan was issued in 2012 for a Low-profile pump with first and second rotor arrangement. This demonstrates a pump with a low-profile disk-type motor that can incorporate an impeller into one or both rotors. Alternately, a separate impeller can be attached to a rotor. The pumps can be contained in housings without seals as the rotors need not be mechanically attached.

G. U.S. Pat. No. 8,500,050 by Ryder was issued in 2013 for a Food waste disposer with restricted grind chamber discharge. This is a food waste disposer that has a grinding mechanism that improves fineness and speed of grinding food waste, and controls or meters the size of the comminuted food waste particles that are discharged from the food waste disposer. It does so by utilizing a more aggressive grind ring of the grinding mechanism that includes horizontal shredder elements in addition to openings and blocking all except the openings in a minor circumferential portion of the grind ring from discharging comminuted food waste and water to a discharge outlet. In an aspect, a resilient seal is used to seal the adapter ring to a housing of an upper end bell of the grinding section and provide a seal for a rotating shredder plate assembly of the food waste disposer.

H. U.S. Pat. No. 9,475,059 by Vallen, et al. was issued in 2016 Cutting blade assembly. This shows a cutting blade assembly that establishes a bidirectional and/or multi-faceted scissor-type cutting action to efficiently and effectively process various types of debris encountered by the cutting blade assembly. The assembly includes a cutting plate and a cutting hub configured for relative rotation. A cutting slot is formed in the cutting plate and intersects the axial face to define a cutting edge at the intersection of the cutting slot and the axial face. The cutting hub has a cutting arm positioned adjacent to the axial face. When the cutting plate and the cutting hub undergo relative rotation, the cutting arm passes adjacent to the cutting edge to perform a scissor-type cutting action.

I. US Patent Application No. 2004/0173697 by Berger et al. was published in 2004 for a Food waste reduction mechanism for disposer. Here is shown various mechanisms for reducing food waste in a food waste disposer are disclosed. In each of the reduction mechanisms, structures are provided for shearing food waste as it passes through or past a rotating shredder plate of the disposer. In one embodiment, the reduction mechanism has a rotatable plate coupled to a rotational source and positioned for rotation relative to an inner wall of a stationary ring. The plate has a fixed lug attached to the rotatable plate and has a movable lug attached to the rotatable plate. In another embodiment, the reduction mechanism includes a rotatable plate coupled to a rotational source and a stationary plate disposed adjacent the rotatable plate. The stationary plate or impeller defines a plurality of apertures therethrough. At least one first portion of the rotatable plate or impeller shears over at least some of the apertures in the stationary plate to shear the food waste.

J. US Patent Application No. 2005/0224611 by Gubler et al. was published in 2005 for a Chopper blade apparatus and method for refining particles. Shown is a particle refining apparatus that is to be integrated into a system including a containment device and an influent conduit. The influent conduit is configured to retain the particle refining apparatus and connected to the containment device. The particle refining apparatus including a shaft, a blade set attached near the end of the shaft and attachment couplings arranged within the influent conduit. A method for refining particles includes introducing particles into an influent conduit, chopping the particles to a desired size with an initial chopping apparatus, directing the chopped particles through the influent conduit, refining the particles to a desired size with a refining apparatus, and moving the particles continuously from the influent conduit through the refining apparatus and into a containment device.

K. US Patent Application No. 2007/0131808 by Anderson et al. was published in 2007 for a Food waste disposer clean-out mechanism. This demonstrates a shredder plate assembly for a food waste disposer includes a disk with one or more water slinging devices attached, so that water flowing into the disposer flows over the water slinging device and against the inside of the disposer housing as the disk rotates.

L. US Patent Application No. 2014/0319252 by McClory was published in 2014 for a Food Waste Disposer with Stamped Swivel Lugs. Here is shown a food waste disposer that includes a food conveying section, a motor section and a grind and discharge section. The grind section includes a grind mechanism having a stationary grind ring and a rotatable shredder plate assembly that rotates within the stationary grind ring to grind food waste. The rotatable shredder plate assembly is rotated by a motor of the motor section. The rotatable shredder plate assembly includes a rotatable shredder plate having a plurality of stamped metal swivel lugs fastened thereon. Each lug includes a base and a face member at a radially outer end extending vertically upward from the base. The face member includes a grind face that bends radially inwardly with a rounded leading vertical outer edge. The base of each lug has a leading edge with a sharp lower edge.

As can be observed, none of the prior art has anticipated or caused one skilled in the grinding or macerating devices and systems to realize or see this invention by Hobbs as obvious to a person skilled in the ordinary art of the industry. The Special improvement package to heavy duty grinders for processing thick wastes and slick wipes in commercial and residential applications and use called a Gorilla Grinder provides an answer to the problem of thick sludge, unwanted paraphernalia and flushable wipes that do not dissolve—all that cause premature blockage of the sanitary sewage and sludge being processed. The invention improves the waste processing and provides a much-improved grinder device for many applications.

SUMMARY OF THE INVENTION

This invention is a Special improvement package to heavy duty grinders for processing thick wastes and slick wipes in commercial and residential applications and use called a Gorilla Grinder. Proposed Solution to the above stated problem is: Since being in the trades the inventor and Hobbs Electric currently has and sells grinder systems. Using current technology and controls engineering the proposal is an improvement kit which applies both mechanical and electrical controls. Mechanical: Using proposed grinder blade and disc with mechanical keyway or spline to permit two-directional movement. Electrical: using designed three phase stator integrated with VFD Variable frequency control (with an IGBT or equal) to permit: Variable Torque, Current, and Speed.

By re-designing the impeller shaft of a typical stator where the shaft would accept a bidirectional blade the rotation of the motor would be reversible. Applying this concept in the event of a clog whether it be from wipes etc. the control system would acknowledge a high current, immediately slow rpm, or stall motor. Wait for cool down/motor stress time then reverse. If a pump encounters certain factors: High Current or High temperature in windings, the motor will stop, wait a period, and reverse again. Most of the time the reversing agitating effect will loosen the blockage. This action would be repeated several times until normal set parameters were obtained. If unachievable then the pump would go into warning mode. Items in the improvement kit which are new to Industry:

1. Application of variable frequency drive (VFD) in a single-phase residential setting which would utilize IGBT technology to fire the motor as a three-phase stator accordingly.
2. Stator redesign to a three-phase design and compacted to accommodate existing pump body size for Original Equipment and Replacement/Aftermarket applications.
3. Cutting component and die cup re-design.
4. Rotor shaft redesign to allow reversing action w/o loosening impeller.
5. Control panel and programming PLC accordingly for the three-phase mimic controller such as the IGBT or equal.

The preferred embodiment of the Special improvement package or kit to heavy duty grinders for processing thick wastes and slick wipes in commercial and residential applications and use called a Gorilla Grinder that is comprised of: (a) a two directional cutter with at least two cutter blades and each blade having a two blade cutter edge; (b) a multi aperture die cup; (c) a shaft for pump with means to permit two-directional rotation such as at least one keyway (for cutter and for the drive connection), splines or equal; (d) an IGBT—insulated gate bipolar transistor for mimicking three phase drive to a motor stator on the pump; (e) a control board/panel with a PLC and an accompanying set of circuitry and wiring to interconnect the IGBT to a three phase stator winding; (f) the a three phase stator winding; and (g) an optional strainer vessel wherein the improvement package and kit for heavy duty grinders provides a grinding solution for contamination including common household trash, a contraband material used in methamphetamine and opioid addictions, a fibrous product including wet wipes with nylon products, and heavy materials that can cause a typical grinding system to be "jetted" which requires continual maintenance and costly repairs.

The newly invented Special improvement package to heavy duty grinders for processing thick wastes and slick wipes in commercial and residential applications and use called a Gorilla Grinder can be manufactured at low volumes by very simple means and in high volume production by more complex and controlled systems.

Objects and Advantages

There are several objects and advantages of the Special improvement package to heavy duty grinders for processing thick wastes and slick wipes in commercial and residential applications and use called a Gorilla Grinder. There are currently no known systems or devices that are effective at providing the objects of this invention.

Special Gorilla Grinder has various advantages and benefits:

| Item | Advantages |
|---|---|
| 1 | reduces maintenance costs of clearing grinder pump of flushable wipes |
| 2 | reduces maintenance costs of clearing needles and drug paraphernalia |
| 3 | provides dual direction cutting blades |
| 4 | has variable torque and speed |
| 5 | provides a lower cost method for three phase advantage with an IGBT or equivalent |
| 6 | can be installed in most current grinder pump packages for original equipment |
| 7 | can be installed with gorilla grinder kit in modified current installations with minimal changes |
| 8 | nearly universal to various grinder pump manufacturers and distributors |
| 9 | allows for a defense to the point of after so many failed attempts a wireless warning could summon proper responders in the act of sabotage |
| 10 | provides a higher head that can be achieved by an increase in rpm to the pump which overcomes the residents "forced main" head flow |

Finally, other advantages and additional features of the present Special improvement package to heavy duty grinders for processing thick wastes and slick wipes in commercial and residential applications and use called a Gorilla Grinder will be more apparent from the accompanying drawings and from the full description of the device. For one skilled in the art of grinder pumps and macerating devices and systems, it is readily understood that the features shown in the examples with this product are readily adapted to other types of grinder systems and devices.

DESCRIPTION OF THE DRAWINGS—FIGURES

The accompanying drawings, which are incorporated in and constitute a part of this specification, illustrate an embodiment of the Special improvement package to heavy duty grinders for processing thick wastes and slick wipes in commercial and residential applications and use called a Gorilla Grinder for various applications device that is preferred. The drawings together with the summary description given above and a detailed description given below explain the principles of the Gorilla Grinder. It is understood, however, that device and system is not limited to only the precise arrangements and instrumentalities shown.

FIGS. 1 A through 1 F are sketches of the general Kit for an Improved Macerating Grinder called Gorilla Grinder.

FIGS. 2 through 2 G are sketches of the general parts for a traditional grinder device with components and features noted.

Figures 3A, 3B, 3C, 3D, 3E:
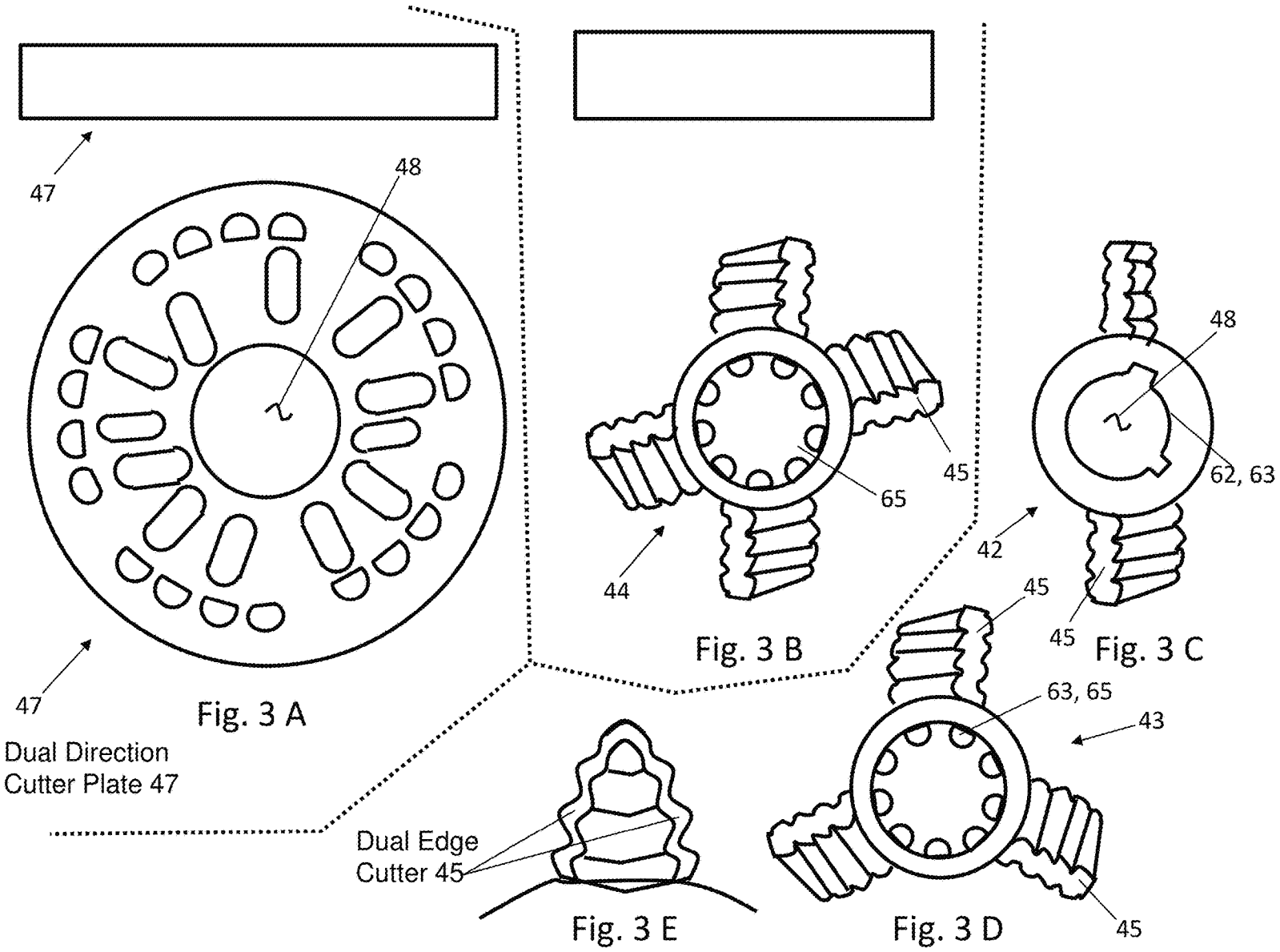
Figure 4A:
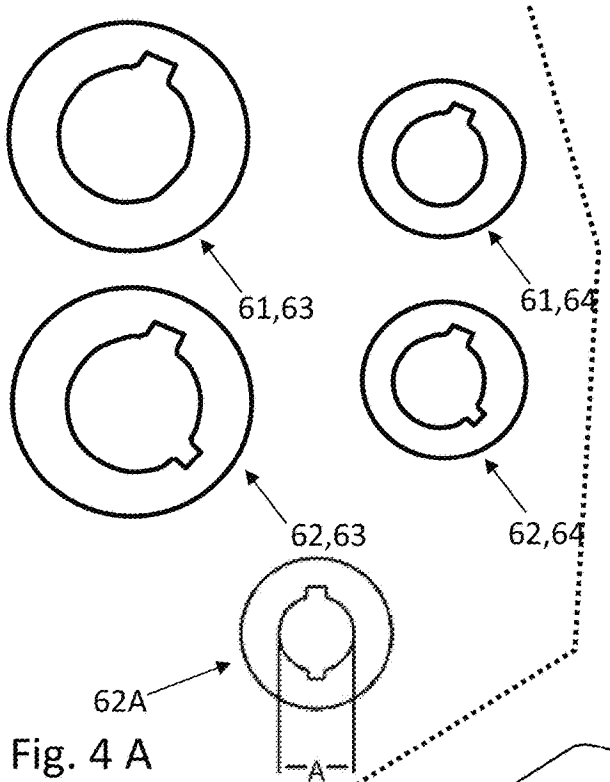
Figure 4B:
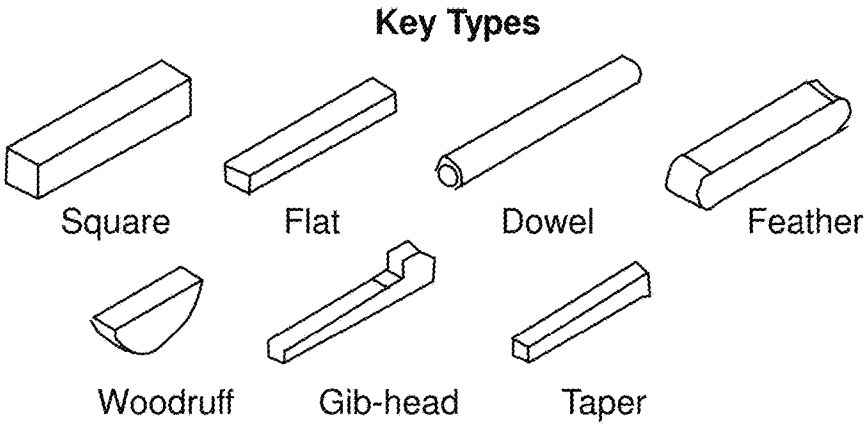
Figure 4D:
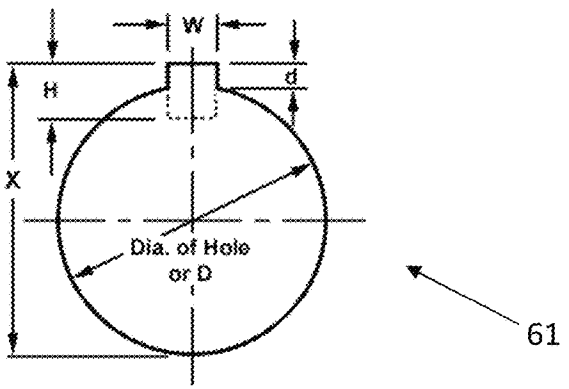
Figure 4C:
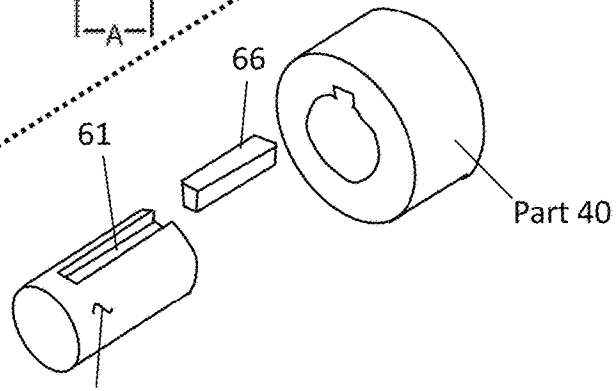

FIGS. 3 A through 3 E are sketches of the improved two-way cutter blades for the improved gorilla grinder with the components and features shown from generally a top view.

FIGS. 4 A through 4 D are sketches of the keyway connection for the shaft at the drive and cutter blades for the improved gorilla grinder.

Figure 6C:
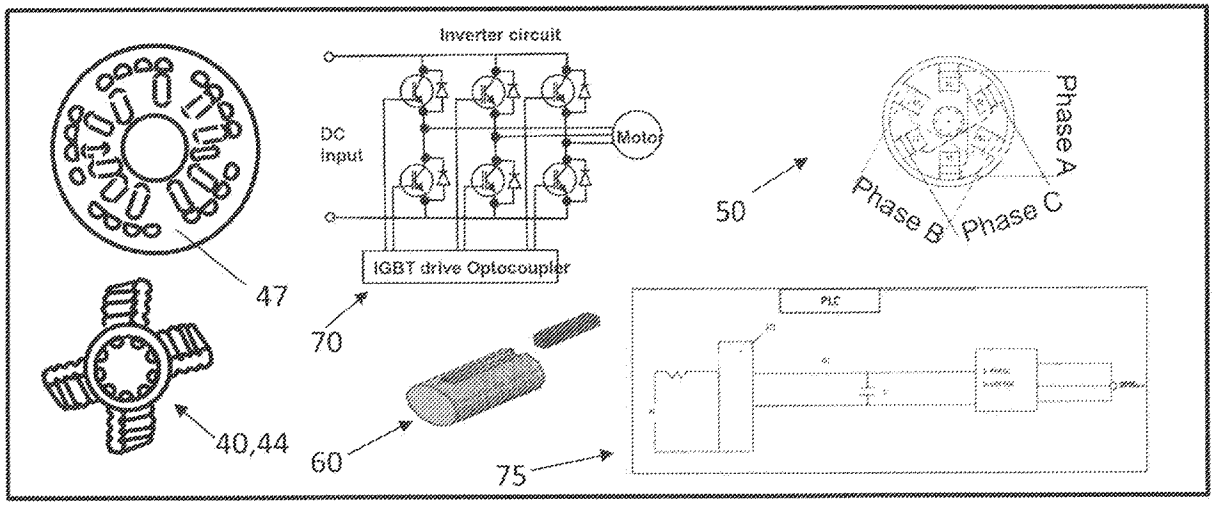
Figure 6B:
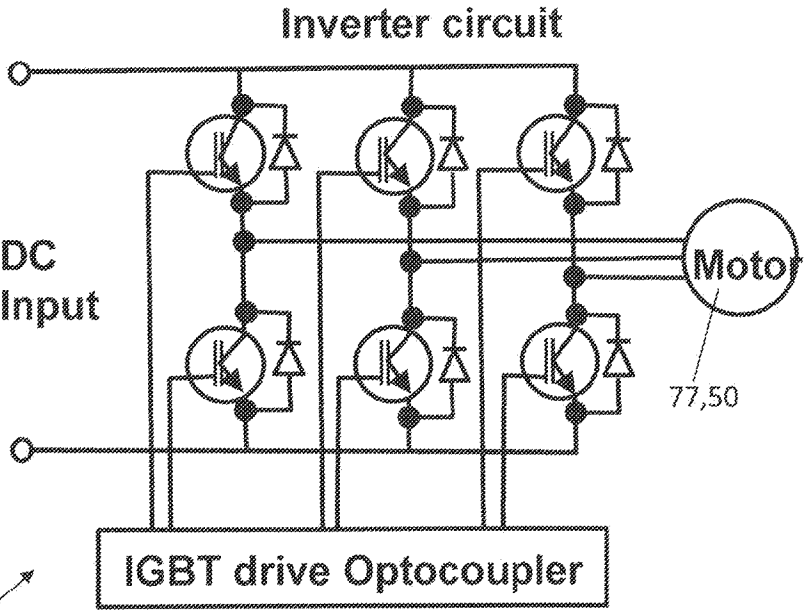
Figure 6A:
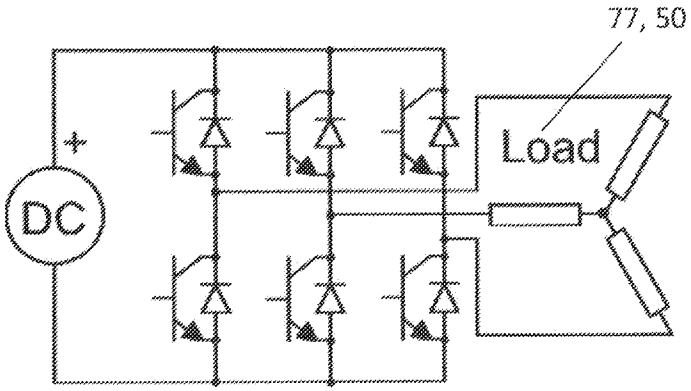
Figure 7A:
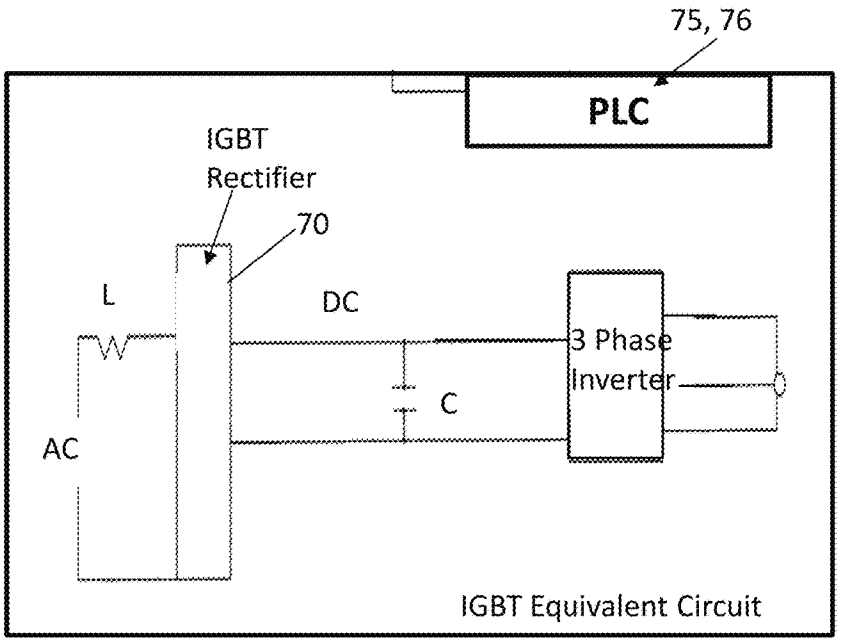
Figure 7B:
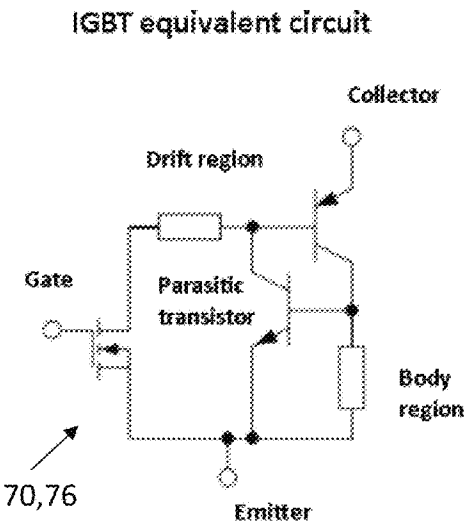
Figure 7D:
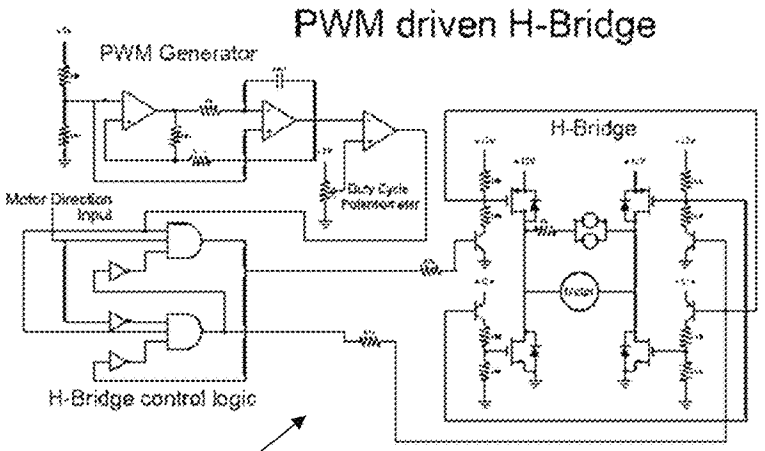
Figure 7C:
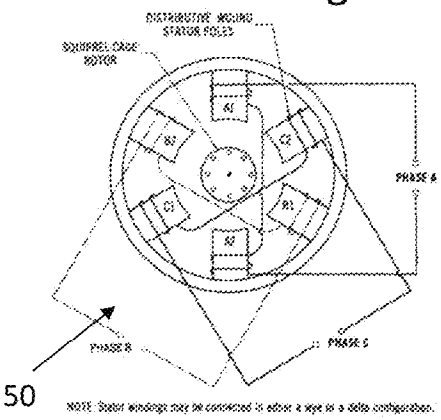
Figure 8A:
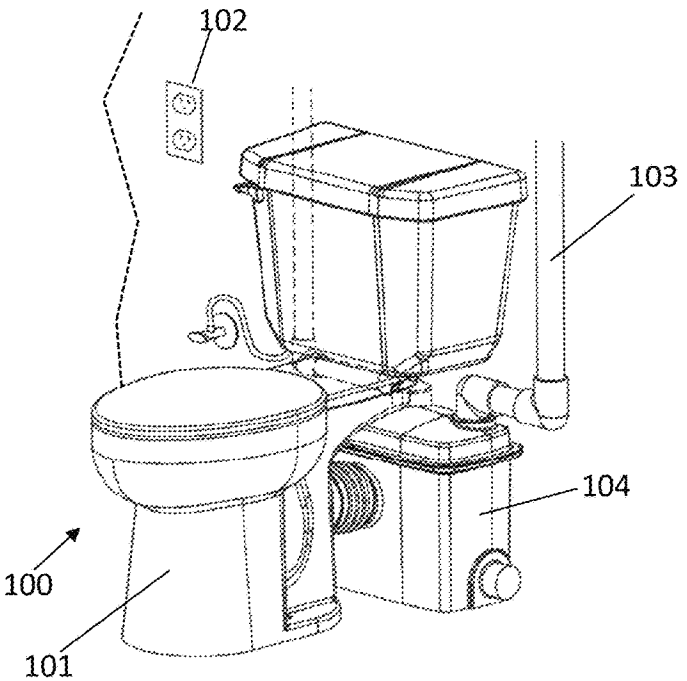
Figure 8B:
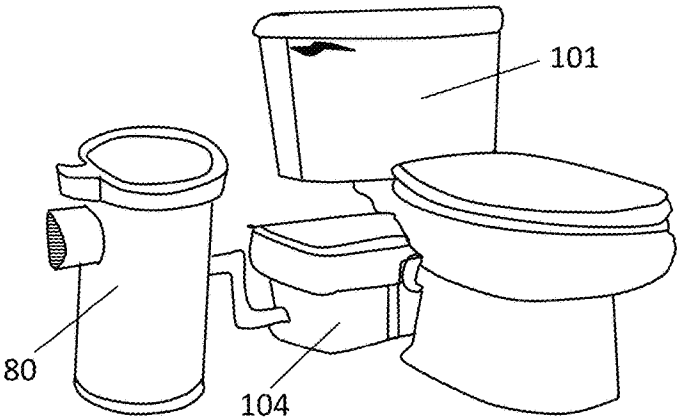
Figure 8C:
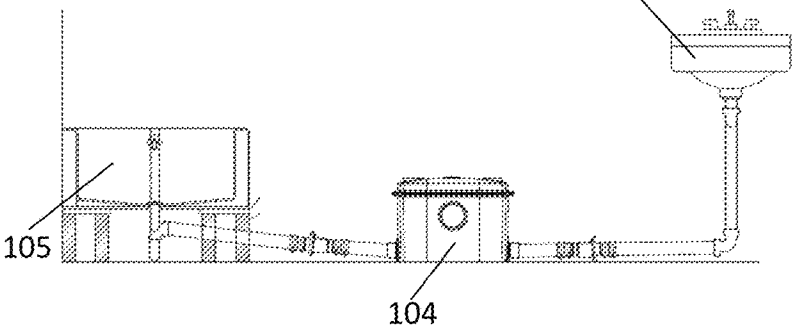
Figure 8D:
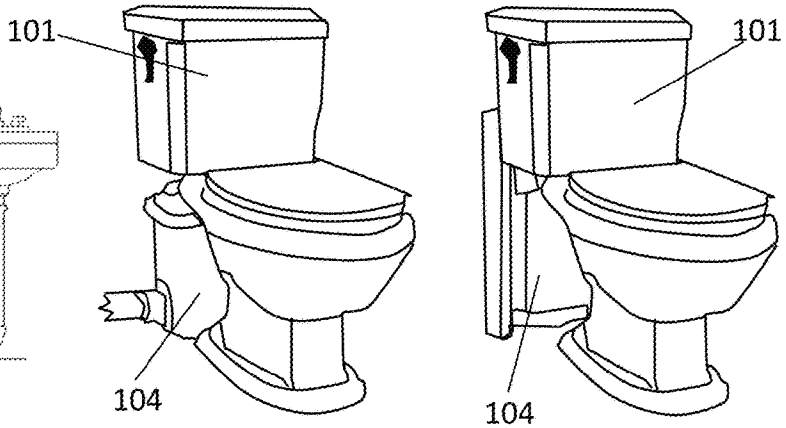

FIGS. 5 A through 5 E are sketches of spline drives on the shaft as well as an optional strainer FIGS. 6 A through 6 C are sketches of electrical circuits to mimic three phase motors and permit variable speed, current and torque for the improved gorilla grinder kit and a typical kit.

FIGS. 7 A through 7 D are sketches of additional electrical diagrams and stator changes for converting to a variable frequency control to permit two directional cutting and variable speed, current and torque.

FIGS. 8 A through 8 D are sketches of installation schemes for traditional one speed, one directional grinder. These applications do not change with the improved gorilla grinder kits.

DESCRIPTION OF THE DRAWINGS—REFERENCE NUMERALS

The following list refers to the drawings:

TABLE B

Reference numbers

| Ref # | Description |
|---|---|
| 30 | improved two directional and variable speed macerating grinder package or kit 30 called a gorilla grinder |
| 34 | traditional cutter 34 |
| 35 | traditional die cup/plate 35 |
| 36 | one direction threaded connection 36 |
| 40 | two directional cutter 40 |
| 42 | two blade cutter 42 |
| 43 | three blade cutter 43 |
| 44 | four blade cutter 44 |
| 45 | two edge cutting surface 45 |
| 47 | multi aperture die cup 47 for gorilla grinder 30 |
| 48 | aperture 48 for shaft 60 |
| 50 | three phase stator winding 50 |
| 60 | shaft 60 for pump 90 with means to permit two-directional rotation such as at least one keyway (for cutter and for the drive connection), splines or equal |
| 61 | single keyway connection 61 between shaft 60 and cutter 40 |
| 62 | double keyway connection 62 between shaft 61 and cutter 40 |
| 62A | opposite double key 62A |
| 63 | means for connecting 63 for cutter 40 |
| 64 | means for connecting 64 for drive end of shaft 60 |
| 65 | spline connection 65 to shaft 60 |
| 65A | spline connection 65A for drive |
| 65B | spline connection 65B for cutter 40 |
| 66 | set of typical key stocks 66 for keyways such as Square, Flat, Dowel, Feather, Woodruff, Gib-head, and Taper keys |
| 70 | IGBT - insulated gate bipolar transistor 70 for mimicking three phase drive to a motor stator 50 on the pump 90 |
| 75 | control board/panel, Programmable Logic Controller (PLC) 75 |
| 76 | circuitry and wiring 76 |
| 77 | motor 77 |
| 80 | optional strainer vessel 80 |
| 90 | typical grinder pump 90 |
| 92 | retainer nut 92 |
| 100 | typical grinder 100 set up with toilet 101 |
| 101 | toilet 101 |
| 102 | electrical power 110 V outlet 102 |
| 103 | vent pipe 103 |
| 104 | pump unit/tank 104 |
| 105 | mop sink 105 |
| 106 | sink 106 |
| 107 | retainer ring 107 and fastener means 107A such as bolts, clips, screws, and pins |
| 110 | collector housing 110 |
| 112 | mounting ledge 112 |
| 114 | collector void 114 |
| 115 | Programmable control board 115 such as an Arduino RTM or the like for programming and controlling the grinder 90 with improvement package 30 |
| 120 | Power width module (PWM) driven H bridge 120 for three phase simulation |

DETAILED DESCRIPTION OF PREFERRED EMBODIMENT

This invention relates to a Special improvement kit or package to heavy duty grinders for processing thick wastes and slick wipes in commercial and residential applications and use called a Gorilla Grinder. Particularly this invention relates generally to grinder pumps and waste disposers and, more particularly, to a pump or waste disposer having a variable speed motor such as a switched reluctance machine. The pump with the improved grinder kit relates to an apparatus that grinds or mills materials and more specifically, the invention relates to an inline apparatus and grinding mechanism that grinds or mills process materials. The grinder pump kit is effective for pumping liquids and slurries containing solid matter, including various types of refuse, and for the improved grinding of the solid matter which thereafter can be processed for disposal. This relates to improvements in pumping apparatus and more particularly, but not by way of limitation, to a disintegrator pump for liquefying solid matter, such as waste products, or the like, for facilitating the draining or discharging thereof. Jamming is a problem that can occur in grinder pumps and disposers. Jamming occurs when hard objects such as needles, inorganic matter or bones enter the pump and get stuck between the cutters or lugs of the rotating grinding plate. Accordingly, a unit having a variable speed motor or a reversible motor improves the performance. The motor current will increase to produce a maximum torque and the motor speed can decrease to zero instantly and reverse direction. In this anti-jamming mode, a maximum current is reached, which helps relieve the jam.

The advantages for the Special improvement package to heavy duty grinders for processing thick wastes and slick wipes in commercial and residential applications and use called a Gorilla Grinder 30 are listed above in the introduction. Succinctly the benefits are that the device:

A. reduces maintenance costs of clearing grinder pump of flushable wipes;
B. reduces maintenance costs of clearing needles and drug paraphernalia;
C. provides dual direction cutting blades;
D. has variable torque and speed;
E. provides a lower cost method for three phase advantage with an IGBT or equivalent;
F. can be installed in most current grinder pump packages for original equipment;
G. can be installed with gorilla grinder kit in modified current installations with minimal changes; and
H. nearly universal to various grinder pump manufacturers and distributors;
I. allows for a defense to the point of after so many failed attempts a wireless warning could summon proper responders in the act of sabotage; and
J. provides a higher head that can be achieved by an increase in rpm to the pump which overcomes the residents "forced main" head flow.

The preferred embodiment of the Special improvement package or kit 30 to heavy duty grinders for processing thick wastes and slick wipes in commercial and residential applications and use called a Gorilla Grinder that is comprised of: (a) a two directional cutter 40 with at least two cutter blades and each blade having a two blade cutter 42 edge; (b) a multi aperture die cup 47; (c) a shaft 60 for pump 90 with means to permit two-directional rotation such as at least one keyway (for cutter and for the drive connection), splines or equal; (d) an IGBT—insulated gate bipolar transistor 70 for mimicking three phase drive to a motor stator 50 on the pump 90; (e) a control board/panel with a Programmable Logic Controller (PLC) 75 and an accompanying set of circuitry and wiring 76 to interconnect the IGBT 70 to a three phase stator winding 50; (f) the a three phase stator winding 50; and (g) an optional strainer vessel 80 wherein the improvement package and kit 30 for heavy duty grinders provides a grinding solution for contamination including common household trash, a contraband material used in methamphetamine and opioid addictions, a fibrous product including wet wipes with nylon products, and heavy materials that can cause a typical grinding system to be "jetted" which requires continual maintenance and costly repairs.

There is shown in FIGS. 1-8 a complete description and operative embodiment of the Special improvement package to heavy duty grinders for processing thick wastes and slick wipes in commercial and residential applications and use called a Gorilla Grinder. In the drawings and illustrations, one notes well that the FIGS. 1-8 demonstrate the general configuration and use of this product. The various example uses are in the operation and use section, below.

The accompanying drawings, which are incorporated in and constitute a part of this specification, illustrate an embodiment of the Special improvement package or kit 30 to heavy duty grinders for processing thick wastes and slick wipes in commercial and residential applications and use called a Gorilla Grinder 30 that is preferred. The drawings together with the summary description given above and a detailed description given below explain the principles of the Special heavy duty grinder kit 30. It is understood, however, that the Gorilla Grinder improvement kit device 30 is not limited to only the precise arrangements and instrumentalities shown. Other examples of grinder improvements components and devices and uses are still understood by one skilled in the art of grinder devices and systems to be within the scope and spirit shown here.

FIGS. 1 A through 1 F are sketches of the general Kit 30 for an Improved Macerating Grinder called Gorilla Grinder. Shown in these views are a four-blade cutter 44; a multi aperture die cup 47 for gorilla grinder 30; an IGBT—insulated gate bipolar transistor 70 for mimicking three phase drive to a motor stator 50 on the pump 90; an optional strainer vessel 80; a typical grinder 100 set up with toilet 101; and a typical grinder pump 90.

FIGS. 2 A through 2 G are sketches of the general parts and components for a traditional grinder device with components and features noted and the new kit 30 components. Demonstrated in these sketches are: a traditional cutter 34; a traditional die cup/plate 35; a one direction threaded connection 36; a two directional cutter 40; a two blade cutter 42; a multi aperture die cup 47 for gorilla grinder 30; a shaft 60 for pump 90 with means to permit two-directional rotation such as at least one keyway (for cutter and for the drive connection), splines or equal; a typical grinder pump 90; a retainer nut 92; a retainer ring 107 and fastener means 107A such as bolts, clips, screws and pins; a collector housing 110; a mounting ledge 112; a collector void 114; and a programmable control board 115 such as an Arduino RTM or the like for programming and controlling the grinder 90 with improvement package 30.

FIGS. 3 A through 3 E are sketches of the improved two-way cutter blades 40 for the improved gorilla grinder kit 30 with the components and features shown from generally a top view. Provided in these sketches are the following: an improved two directional and variable speed macerating grinder package or kit 30 called a gorilla grinder; a two-blade cutter 42; a three-blade cutter 43; a four-blade cutter 44; a two-edge cutting surface 45; a multi aperture die cup 47 for gorilla grinder 30; an aperture 48 for shaft 60; a double keyway connection 62 between shaft 61 and cutter 40; a means for connecting 63 for cutter 40; and a spline connection 65 to shaft 60.

FIGS. 4 A through 4 D are sketches of the key-way connection 61 for the shaft 60 at the drive and cutter blades 40 for the improved gorilla grinder kit 30. Demonstrated are: a shaft 60 for pump 90 with means to permit two-directional rotation such as at least one keyway (for cutter and for the drive connection), splines or equal; a single keyway connection 61 between shaft 60 and cutter 40; a double keyway connection 62 between shaft 61 and cutter 40; an opposite double key 62A; a means for connecting 63 for cutter 40; a means for connecting 64 to drive at end of shaft 60; and a set of typical key stocks 66 for keyways such as Square, Flat, Dowel, Feather, Woodruff, Gib-head, and Taper keys.

FIGS. 5 A through 5 E are sketches of spline drives 65 on the shaft 60 as well as an optional strainer 80. Here in these sketches are exhibited: a two directional cutter 40; a four-blade cutter 44; a shaft 60 for pump 90 with means to permit two-directional rotation such as at least one keyway (for cutter and for the drive connection), splines or equal; a means for connecting 63 for cutter 40; a means for connecting 64 for drive; a spline connection 65 to shaft 60; a spline connection 65A for drive; a spline connection 65B for cutter 40; and an optional strainer vessel 80.

FIGS. 6 A through 6 C are sketches of electrical circuits 76 to mimic three phase motors and permit variable speed, current and torque for the improved gorilla grinder kit and a typical kit 30. Provided in these views are: an improved two directional and variable speed macerating grinder package or kit 30 called a gorilla grinder; a two directional cutter 40; a four blade cutter 44; a multi aperture die cup 47 for gorilla grinder 30; a three phase stator winding 50; a shaft 60 for pump 90 with means to permit two-directional rotation such as at least one keyway (for cutter and for the drive connection), splines or equal; an IGBT—insulated gate bipolar transistor 70 for mimicking three phase drive to a motor stator 50 on the pump 90; a control board/panel, PLC 75; a circuitry and wiring 76; and a motor 77.

FIGS. 7 A through 7 D are sketches of additional electrical diagrams 75, 76 and stator changes 50 for converting to a variable frequency control to permit two directional cutting and variable speed, current and torque. Demonstrated here are the following: a three-phase stator winding 50; an IGBT—insulated gate bipolar transistor 70 for mimicking three phase drive to a motor stator 50 on the pump 90; a control board/panel, PLC 75; a circuitry and wiring 76 and a power width module (PWM) driven H bridge 120 for three phase simulation. Regarding the IGBT power cycling and lifetime testing, IGBTs have been shaping the technological landscape for quite some time. One of the typical applications for IGBTs is a three-phase inverter circuit. The three main components in an IGBT can be divided into the die attach, die interconnect and DBC/baseplate. All of these are the focus of studies, where new ideas continue to emerge that also need to be tested and verified. As an alternative to the IGBT system, a series of MOSFETS may be implemented within the spirit and scope of this invention 30.

FIGS. 8 A through 8 D are sketches of installation schemes for traditional one speed, one directional grinder. These applications do not change with the improved gorilla grinder kit 30. In these views are shown: an optional strainer vessel 80; a typical grinder pump 90; a typical grinder 100 set up with a grinder pump 90 contiguous to a toilet 101; a toilet 101; an electrical power 110 V outlet 102; a vent pipe 103; a pump unit/tank 104; a mop sink 105; and a sink 106. The main use for the improvement kit 30 is with rear outlet toilets that have a discharge height of 4" from floor to centerline. However, as shown, additional ports can accommodate a lavatory sink, bathtub and/or shower.

Materials for the kit anticipate for example, but are not limited to, premium Grinder Blade that is investment-cast 440 stainless steel, 304 stainless steel, a cutter plate that is engineered to handle loth, latex and other hard to grind materials, carbon/ceramic mechanical shaft seals, upper and lower ball bearings continuously bathed in oil, a multiple of independent cutting channels to provide over 250,000 cuts per minute, non-corrosive engineered thermoplastic parts, automatic reset thermal overload protection, and stainless steel screws, bolts, & handle. The components and features of the parts for the improvement kit 30 anticipate to include but are not limited to the following durable materials: such as metals—steel alloys, nickel, brass, pot metals, aluminum, titanium and the like and polymers such as fairly high durometer, urethane, nylon, reinforced nylon, polyvinyl chloride (PVC), silicone, thermoplastic elastomers (TPE), Acrylonitrile Styrene (ASA); Acrylonitrile Butadiene Styrene (ABS) Plastic; polycarbonate—Acrylonitrile Butadiene Styrene (PC-ABS); polylactic acid (PLA); Polyamide (PA-nylon), Glass Filled Polyamide, and composite materials and the like.

The details mentioned here are exemplary and not limiting. Other specific components and manners specific to describing a Special improvement package to heavy duty grinders for processing thick wastes and slick wipes in commercial and residential applications and use called a Gorilla Grinder 30 may be added as a person having ordinary skill in the field of grinder and macerating devices and systems and their uses well appreciates.

Operation of the Preferred Embodiment

The Special improvement package to heavy duty grinders for processing thick wastes and slick wipes in commercial and residential applications and use called a Gorilla Grinder 30 has been described in the above embodiment. The manner of how the device operates is described below. One notes well that the description above and the operation described here must be taken together to fully illustrate the concept of the Gorilla Grinder improvement kit 30. The preferred embodiment of the Special improvement package or kit 30 to heavy duty grinders for processing thick wastes and slick wipes in commercial and residential applications and use called a Gorilla Grinder that is comprised of: (a) a two directional cutter 40 with at least two cutter blades and each blade having a two blade cutter 42 edge; (b) a multi aperture die cup 47; (c) a shaft 60 for pump 90 with means to permit two-directional rotation such as at least one keyway (for cutter and for the drive connection), splines or equal; (d) an IGBT—insulated gate bipolar transistor 70 for mimicking three phase drive to a motor stator 50 on the pump 90; (e) a control board/panel with a Programmable Logic Controller (PLC) 75 and an accompanying set of circuitry and wiring 76 to interconnect the IGBT 70 to a three phase stator winding 50; (f) the a three phase stator winding 50; and (g) an optional strainer vessel 80 wherein the improvement package and kit 30 for heavy duty grinders provides a grinding solution for contamination including common household trash, a contraband material used in methamphetamine and opioid addictions, a fibrous product including wet wipes with nylon products, and heavy materials that can cause a typical grinding system to be "jetted" which requires continual maintenance and costly repairs.

Current Typical grinders: Grinder under current condition uses single phase power typical in most residences. There are single phase pumps which utilize a forward reversing action but not in a VFD application which is using a 3/phase drive for rotations, speed, torque requirements to deliver a varying head to gallons per/min. The usual outcome historyically with existing pumps/controls is component failure and often pump failures. Using current technology and controls engineering the proposal is an improvement kit which applies both mechanical and electrical controls. Mechanical: Using proposed grinder blade and disc with mechanical keyway or spline to permit two-directional movement. Electrical: using designed three phase stator integrated with VFD Variable frequency control (with an IGBT or equal) to permit: Variable Torque, Current, and Speed.

By re-designing the impeller shaft of a typical stator where the shaft would accept a bidirectional blade the rotation of the motor would be reversible. Applying this concept in the event of a clog whether it be from wipes etc. the control system would acknowledge a high current, immediately slow rpm, or stall motor. Wait for cool down/motor stress time then reverse. If a pump encounters certain factors: High Current or High temperature in windings, the motor will stop, wait a period, and reverse again. Most of the time the reversing agitating effect will loosen the blockage. This action would be repeated several times until normal set parameters were obtained. If unachievable then the pump would go into warning mode. Items in the improvement kit which are new to Industry:

1. Application of variable frequency drive (VFD) in a single-phase residential setting which would utilize IGBT technology to fire the motor as a three-phase stator accordingly.
2. Stator redesign to a three-phase design and compacted to accommodate existing pump body size for Original Equipment and Replacement/Aftermarket applications.
3. Cutting component and die cup re-design.
4. Rotor shaft redesign to allow reversing action w/o loosening impeller.
5. Control panel and programming PLC accordingly for the three-phase mimic controller such as the IGBT or equal.

The Special improvement package 30 to heavy duty grinders for processing thick wastes and slick wipes in commercial and residential applications allows the grinder pump to stop, reverse direction, and then have variable speed and torque to remove the jamming materials or slick, flushable wipes. It may even agitate first in one direction, reverse, and go the opposite direction for several cycles. This control is al designed in the control board/panel, PLC 75. It permits the grinder pump to free itself of the jamb rather than needing removed, disassembled, and jetted with pressured water to remove the blockage(s). The two-way, bi-directional blades are secured with mechanical keys and keyways between the shaft and cutters and the drive rather than the one-directional threaded jamb nuts of the traditional grinder. The system may be augmented with a strainer basket 80 for applications that see an increased amount of inorganic or metal drug-paraphernalia.

In the event of sabotage the controls would act as a defense to the point of after so many failed attempts a wireless warning could summon proper responders. This could be useful in military or private industry settings where security is paramount. Therefore, the improvement package 30 allows for a defense to the point of after so many failed attempts a wireless warning could summon proper responders in the act of sabotage. And, traditionally, most residents will have a "forced main" head flow resistance. With the improvement package 30, a higher head could be achieved by an increase in rpm and therefore provides a higher head that can be achieved by an increase in RPM to the pump which overcomes the residents "forced main" head flow.

Many uses are anticipated for the Special improvement package to heavy duty grinders for processing thick wastes and slick wipes in commercial and residential applications and use called a Gorilla Grinder 30 improvement kit. It is fully expected that the Gorilla grinder kit 30 can be adapted for the various one directional, single speed and less powerful grinder pumps already being used (i.e., manufacturers such as Zoeller, Ashland, Champion, McDonald, Sulzer, Franklin, Pentair, Meyers, Barnes, Liberty, etc.). Some examples of typical applications and uses, strictly as examples and not as limitations, are shown in the following Table.

| ITEM | DESCRIPTION |
|---|---|
| 1 | Day Care facilities |
| 2 | Hospitals and clinics |
| 3 | Schools |
| 4 | Nursing homes |
| 5 | Waste Treatment Plants (WTP) |
| 6 | Lift Stations |
| 7 | Restaurants |
| 8 | Dairy farms and Concentrated animal feeding operations (CAFO) |
| 9 | Food processing plants |

With this description it is to be understood that the Special improvement package to heavy duty grinders for processing thick wastes and slick wipes in commercial and residential applications and use called a Gorilla Grinder 30 improvement kit is not to be limited to only the disclosed embodiment of product. The features of the Gorilla Grinder 30 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and, in its operation, can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. Various features and aspects of the disclosed embodiments can be combined with or substituted for one another to form varying modes of the disclosed inventions. Thus, it is intended that the scope of at least some of the present inventions herein disclosed should not be limited by the disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed considering the number of recited significant digits and by applying ordinary rounding techniques.

The present invention contemplates modifications as would occur to those skilled in the art. While the disclosure has been illustrated and described in detail in the figures and the foregoing description, the same is to be considered as illustrative and not restrictive in character, it being understood that only selected embodiments have been shown and described and that all changes, modifications, and equivalents that come within the spirit of the disclosures described heretofore and or/defined by the following claims are desired to be protected.

What is claimed is:

1. An improvement kit configured to provide replacement components to an existing heavy-duty grinder pump, the improvement kit includes a group of both mechanical and electrical replacement components to the grinder pump and, the improvement kit is made of durable materials and further comprising:

(a) a replacement two-directional cutter component that has at least two cutter blades wherein each cutter blade features a two-blade cutter edge;

(b) a replacement multi-aperture die cup/cutter plate;

(c) a replacement drive shaft for the heavy-duty grinder pump wherein the replacement shaft has a means for connecting the replacement shaft to the drive of the grinder pump allowing for two-directional/reversible rotation of the replacement shaft;

(d) a replacement three-phase stator winding;

(e) an electrical component that provides a three-phase, variable frequency drive (VFD) to the replacement three phase motor stator on the motor of the existing heavy duty grinder pump; and (f) a control board/panel with a programmable logic controller (PLC) and an accompanying set of electrical circuitry and wiring for connecting the three-phase component to the three-phase stator winding, wherein the existing heavy-duty grinder pump is characterized as a pump that has a one-directional cutter blade, a single-phase electrical control, and a non-reversing motor and drive shaft and wherein the improvement kit, when fitted onto the existing heavy duty grinder pump, provides a grinding solution for contamination including common household trash, a contraband material used in methamphetamine and opioid addictions, a fibrous product including wet wipes with nylon products, and heavy materials that require continual maintenance and costly repairs for both commercial and residential applications.

2. The improvement kit for an existing heavy-duty grinder pump as described in claim 1 wherein the improvement kit further comprises a strainer vessel.

3. The improvement kit for an existing heavy-duty grinder pump as described in claim 1 wherein the at least two cutter blades comprises three cutter blades.

4. The improvement kit for an existing heavy-duty grinder pump as described in claim 1 wherein the at least two cutter blades comprises four cutter blades.

5. The improvement kit for an existing heavy-duty grinder pump as described in claim 1 wherein the durable materials are selected from the group consisting of metals and polymers.

6. The improvement kit for an existing heavy-duty grinder pump as described in claim 5 wherein the metals are selected from the group consisting of steel alloys, stainless steel, 304 stainless steel, 440 stainless steel, nickel, brass, pot metals, aluminum, and titanium.

7. The improvement kit for an existing heavy-duty grinder pump as described in claim 5 wherein the polymers are selected from the group consisting of high durometer, urethane, nylon, reinforced nylon, polyvinyl chloride (PVC), silicone, thermoplastic elastomers (TPE), Acrylonitrile Styrene (ASA); Acrylonitrile Butadiene Styrene (ABS) Plastic; polycarbonate—Acrylonitrile Butadiene Styrene (PC-ABS); polylactic acid (PLA); Polyamide (PA-nylon), Glass Filled Polyamide, and composite materials.

8. The improvement kit for an existing heavy-duty grinder pump as described in claim 1 wherein the electrical component (70) that provides a three-phase, variable frequency drive (VFD) is an insulated gate bipolar transistor (IGBT).

9. The improvement kit for an existing heavy-duty grinder pump as described in claim 1 wherein the electrical component that provides a three-phase, variable frequency drive (VFD) is a Power width module (PWM) driven H bridge.

10. The improvement kit for an existing heavy-duty grinder pump as described in claim 1 wherein the control board is an Arduino RTM programmable module.

11. The improvement kit for an existing heavy-duty grinder pump as described in claim 1 wherein the means for connecting to the drive to permit two-directional rotation of the shaft is selected from the group of keys and keyways consisting of Square, Flat, Dowel, Feather, Woodruff, Gibhead, and Taper keys and keyways.

12. An improvement kit for an existing heavy-duty grinder pump, the improvement kit includes a group of both mechanical and electrical components to the grinder pump, said improvement kit is made of durable materials and comprising:

(a) a replacement two-directional cutter with two cutter blades wherein each blade has a two-blade cutter edge;

(b) a replacement multi-aperture die cup/cutter plate;

(c) a replacement drive shaft for the heavy-duty grinder pump with a spline for connecting the shaft to the drive to permit two-directional/reversible rotation of the shaft;

(d) a replacement three-phase stator winding;

(e) an insulated gate bipolar transistor (IGBT) that provides a three-phase, variable frequency drive (VFD) to the replacement three phase motor stator on the motor of the existing heavy duty grinder pump; and (f) an Arduino RTM programmable module in a top area of the heavy-duty grinder pump with a programmable logic controller (PLC) and an accompanying set of circuitries and wiring for connecting the three-phase component to the three-phase stator winding, wherein the traditional heavy-duty grinder pump is characterized as a pump that has a one-directional cutter blade, a single-phase electrical control, and a non-reversing motor and drive shaft and wherein the improvement kit when fitted onto the existing heavy duty grinder pump provides a grinding solution for contamination including common household trash, a contraband material used in methamphetamine and opioid addictions, a fibrous product including wet wipes with nylon products, and heavy materials that require continual maintenance and costly repairs for both commercial and residential applications.

13. The improvement kit for an existing heavy-duty grinder pump as described in claim 12 wherein the improvement kit further comprises a strainer vessel.

14. The improvement kit for an existing heavy-duty grinder pump as described in claim 12 wherein the durable materials are selected from the group consisting of metals and polymers.

15. The improvement kit for an existing heavy-duty grinder pump as described in claim 14 wherein the metals are selected from the group consisting of steel alloys, stainless steel, 304 stainless steel, 440 stainless steel, nickel, brass, pot metals, aluminum, and titanium.

16. The improvement kit for an existing heavy-duty grinder pump as described in claim 14 wherein the polymers are selected from the group consisting of high durometer, urethane, nylon, reinforced nylon, polyvinyl chloride (PVC), silicone, thermoplastic elastomers (TPE), Acrylonitrile Styrene (ASA); Acrylonitrile Butadiene Styrene (ABS) Plastic; polycarbonate—Acrylonitrile Butadiene Styrene (PC-ABS); polylactic acid (PLA); Polyamide (PA-nylon), Glass Filled Polyamide, and composite materials.

* * * * *